United States Patent [19]

O'Connell

[11] Patent Number: 4,763,804

[45] Date of Patent: Aug. 16, 1988

[54] AUTOCLAVABLE TISSUE CULTURE CONTAINER AND CLOSURE

[75] Inventor: Dennis M. O'Connell, Corning, N.Y.

[73] Assignee: Corning Glass Works, Corning, N.Y.

[21] Appl. No.: 85,161

[22] Filed: Aug. 14, 1987

[51] Int. Cl.[4] ..... B65D 51/16

[52] U.S. Cl. ..... 215/307; 215/330; 215/331; 220/366

[58] Field of Search ..... 215/307, 330, 331; 220/366

[56] References Cited

U.S. PATENT DOCUMENTS

| | | | |
|---|---|---|---|
| 2,877,918 | 3/1959 | Gardner | 215/307 X |
| 4,206,852 | 6/1980 | Dunn et al. | 215/307 X |
| 4,289,248 | 9/1981 | Lynn | 215/330 |
| 4,392,055 | 7/1983 | Whitney | 215/307 |
| 4,392,579 | 7/1983 | Uhlig et al. | 215/307 X |
| 4,456,137 | 6/1984 | Lyman | 215/307 X |
| 4,546,085 | 10/1985 | Johansson et al. | 215/222 |

*Primary Examiner*—Stephen Marcus
*Assistant Examiner*—Nova Stucker
*Attorney, Agent, or Firm*—Burton R. Turner

[57] ABSTRACT

A novel closure and container assembly is disclosed which provides for the definite and positive positioning of the closure on the container in a predetermined semi-open positionment. The container is provided with a rim portion which extends within a plane perpendicular to the axis of the cylindrical neck portion of the container and has a tapered surface lying within a cone concentric with such axis, whereas the closure is also provided with a tapered surface lying within a surface of a cone concentric with such axis so that upon the threading of the closure onto the container the surfaces engage each other within the surface of a cone lying concentric to the axis of the cylindrical neck portion and create a binding action which positions the closure in its predetermined semi-open positionment on the container. A further twisting of the closure allows the closure to sealably engage the container.

10 Claims, 2 Drawing Sheets

AUTOCLAVABLE TISSUE CULTURE CONTAINER AND CLOSURE

BACKGROUND OF THE INVENTION

The invention relates to a tissue culture or cell cultivation container and closure. In the growing of tissue cultures or cells it is customary to use containers provided with an air tight screw cover in order to prevent contamination of the cell material and also to prevent the escape of cells or substrate to the surroundings. However, the use of such air tight screw covers involves various problems. During the autoclaving of such containers, the closure must be in a slightly open position in order to permit the ambient atmosphere of the autoclaving process to reach and sterilize the interior of the container. Further, it is necessary for the closure to be in a slightly open position during the heating phase in order to prevent an undesirable positive pressure within the container, and also during the cooling phase in order to prevent the generation of an undesirable negative pressure. Further, the positioning of the closure in a predetermined slightly opened position, permits a means for an atmospheric exchange during the tissue culture growth process.

Other container-closure assemblies have been provided in the past having means for an intermediate cooperative positioning of the closure with respect to the container; however, they have not been completely satisfactory since the cap or closure and the positioning mechanism did not provide for a stable positive positioning of the closure or cap. For example, U.S. Pat. No. 4,289,248 utilized a pair of detents on opposite sides of the neck of the container or closure, and a detent formed on opposite sides of the closure or container engagable therewith for positioning the closure in a predetermined open position on the container. Since the closures traditionally have a loose fit upon such containers, there is always a problem of the cap or closure flopping or cocking from side-to-side during the positioning of the closure on the container, and accordingly it was possible to completely miss the detents altogether.

U.S. Pat. No. 4,546,085 incorporated the use of a container having a stepped or offset neck portion and a closure having an annular bead for sealing the container. When the bead was moved to a zone adjacent the offset portion, venting of the container was possible, however, no positive positioning mechanism was employed. Again, such design did not necessarily provide a positive and stable cap placement upon the container as obtained in the present invention.

SUMMARY OF THE INVENTION

In its simplest form, the present invention sets forth a novel closure-container assembly construction which facilitates a positive and stable cap or closure placement upon the container, while providing for a positive means of positioning the closure in a predetermined semi-open positionment on the container. The neck of the container is provided with radially-outwardly directed ring means at a predetermined distance below an upper open edge portion of the container, and a skirt portion of the cap or closure is provided with a plurality of inwardly extending projections which cooperate with the radially-outwardly directed ring means to positively position the cap in a predetermined semi-open position on the container.

Thus, it has been an object of the invention to provide a container and closure assembly having means for stably receiving and positively positioning the closure on the container in a predetermined semi-open positionment, while also permitting the complete sealing of the container by the closure.

DESCRIPTION OF THE PREFERRED EMBODIMENTS

Figure 1:
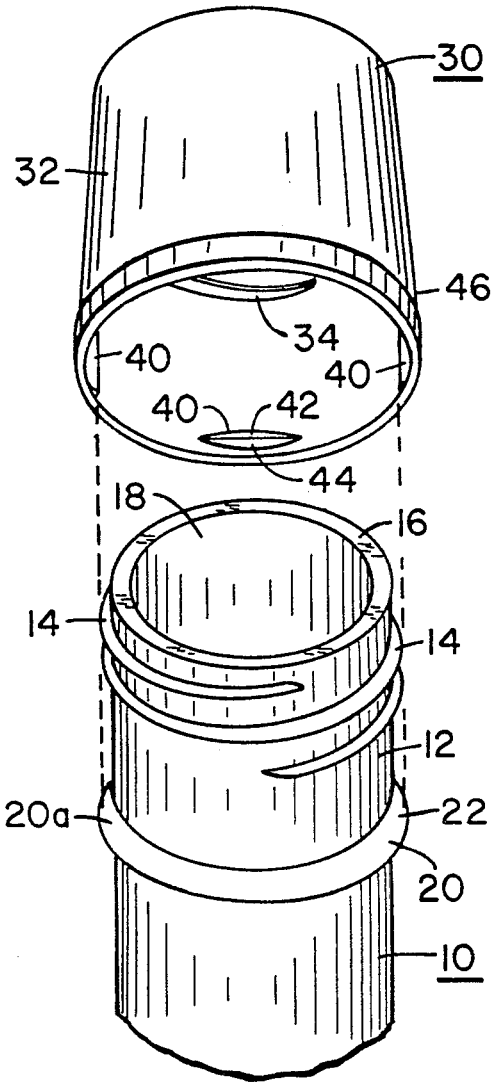
FIG. 1 is a schematic isometric view of the neck of a container and a closure embodying the present invention.
Figure 2:
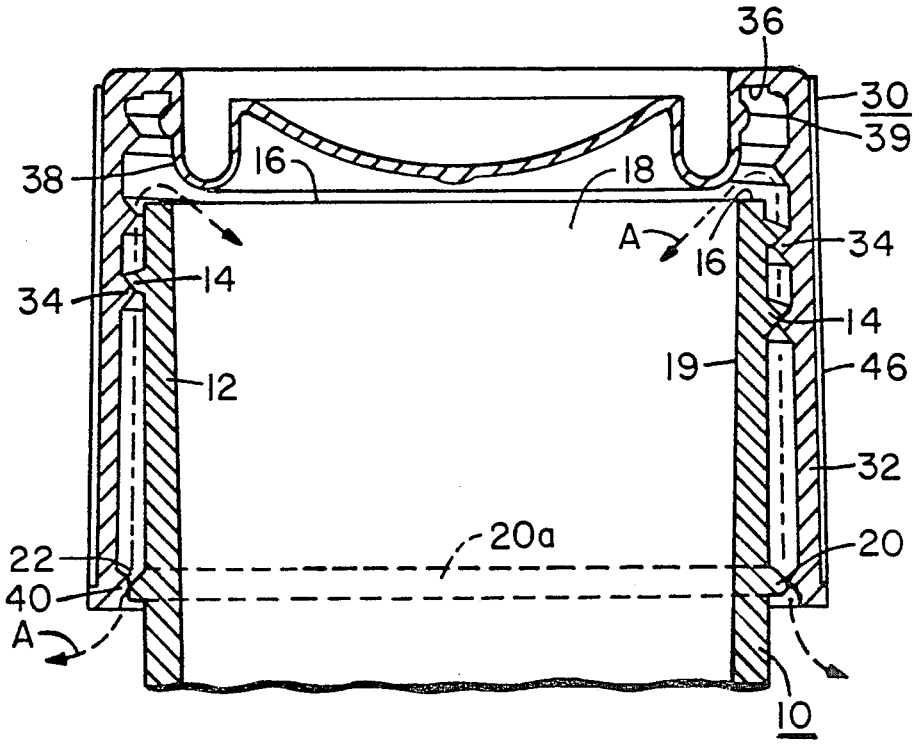
FIG. 2 is a cross-sectional view in elevation showing the closure in a predetermined semi-open position on the neck of the container.
Figure 3:
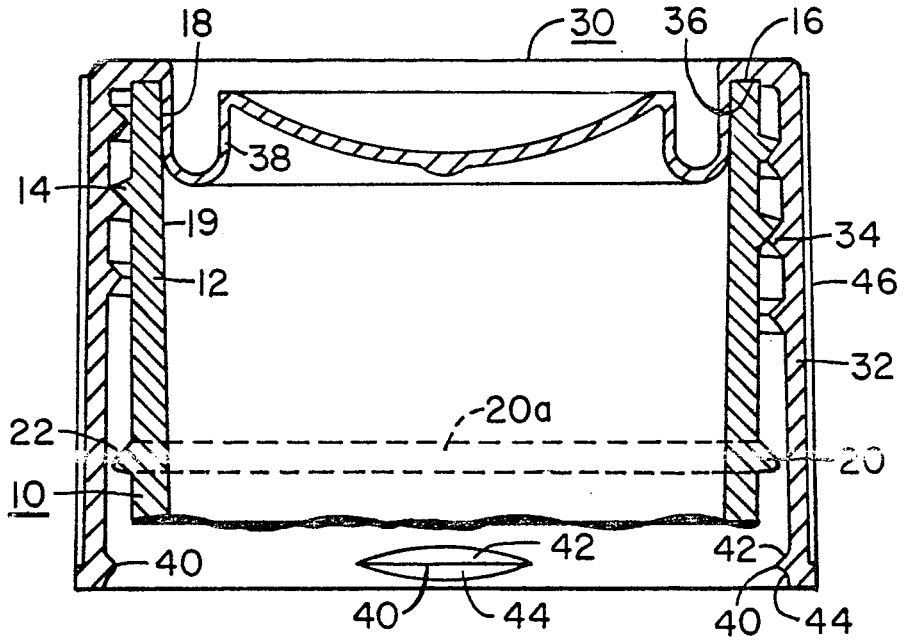
FIG. 3 is a cross-sectional view in elevation showing the closure in a sealed position on the container.

Referring now to the drawings, and particularly FIGS. 1, 2 and 3, a container 10 is shown having a substantially cylindrical neck portion 12 provided with external threads 14 which extend downwardly below an upper sealing edge surface portion 16 about the open mouth 18 of the container. An outwardly extending rim means 20, projecting radially-outwardly from the neck portion 12 at a predetermined distance below the upper sealing edge 16, is shown in FIG. 1 as a continuous rim **20*a*. The rim 20*a* encircles the neck portion 12 of the container 10 and lies within a plane extending perpendicular to the cylindrical axis of the neck portion 12. As shown, the rim 20*a* preferrably has an outwardly-downwardly tapered operating or abutment surface 22, which lies within a surface of a cone which intersects and is concentric with the axis of the cylindrical neck portion 12**.

A cap or closure 30 is shown having a substantially cylindrical skirt portion 32 provided with internal threads 34 which engage the external threads 14 of the container 10. The cap 30 has a closed upper end including an annular U-shaped sealing portion 38, inwardly offset from the skirt portion 32, and providing an upper sealing surface portion 36 therebetween. The annular U-shaped portion 38 has an annular bead portion 39 for sealable engaging an inner surface 19 of the neck portion of container 10. In addition, the closure 30 is provided with a plurality of inwardly extending projections 40 positioned about the inner surface of the skirt portion 32 adjacent its lower extent. Although various geometric arrangements of such projections may be utilized, two pairs of opposed arcuately extending projections 40 are shown, having tapered upper and lower surface portions 42, 44, respectively, which lie within cones concentric with the axis of the cylindrical skirt 32. The closure may have a knurled gripping portion 46 about its outer surface, and the skirt portion may have a slight taper as may be necessitated in manufacturing the same.

In operation, the closure 30 is positioned upon the neck portion 12 of the container 10 and the internal threads 34 engage the external threads 14, allowing the cap or closure 30 to be screwed downwardly onto the container 10. As the closure is threaded toward its closed position upon the container 10, the inwardly extending arcuate projections 40 on the interior of the skirt portion 32 of cap 30, contact the outwardly extending rim means 20 formed on the exterior surface of the neck portion 12 of container 10. As the tapered surfaces 44 of the projections 40 engage the tapered surface 22 of the rim means 20, a binding action is occasioned therebetween within the surface of a cone concentric with the axes of the neck and skirt portions, which positively positions the cap in a predetermined slightly opened position on the container. That is, the contact between the projections 40 and the outwardly extending rim means 20 functions to detain the closure sealing surface portions 36 and 39 from contacting the sealing surfaces 16 and 19, respectively, of the container, and thereby prevent the formation of a seal between the container and the closure to allow air movement into and out of the container, as shown by arrows A in FIG. 2.

An additional torsional force on the cap 30 overcomes the binding between the tapered surfaces 22 and 44, causing a slight deformation of the closure and its inwardly extending projections 40 as they move past the outwardly extending rim means 20 on the container, allowing the closure sealing surfaces 36, 39 to engage and be secured against the container sealing surfaces 16, 19 respectively to seal the closure on the container and thereby prevent the container contents from exiting, or contaminants from entering, the closed system as shown in FIG. 3. Further, the cap 30 may be moved from the sealed positionment of FIG. 3 to a semi-open vented positionment, by unscrewing the cap until the tapered surfaces 42 of projections 40 engage the rim means 20, creating a binding action to positively position the cap in a semi-open position while locking the cap on the container and inhibiting it from becoming unscrewed. Preferrably, the closure is made of a plastic material, such as polypropylene which is plyable enough to permit some mechanical deformation and have a high enough softening point to permit steam autoclaving without thermal deformation.

As will be appreciated, the inwardly extending projections 40 on the inside of the closure 30 can contact the continuous rim **20*a*** at any point on the rim means, and thereby provide a stable and definite positioning of the closure with its sealing surfaces above the sealing surfaces of the container, when it is desired to temporarily position the closure in a semi-open position. When additional torque is applied to the closure, the closure deforms and permits the tapered surfaces of the closure projections to slide over the tapered surfaces of the rim means on the container, and thereby allow the removal of the closure, or allow the closure and container sealing surfaces to contact one another and provide a seal therebetween.

Figure 4:
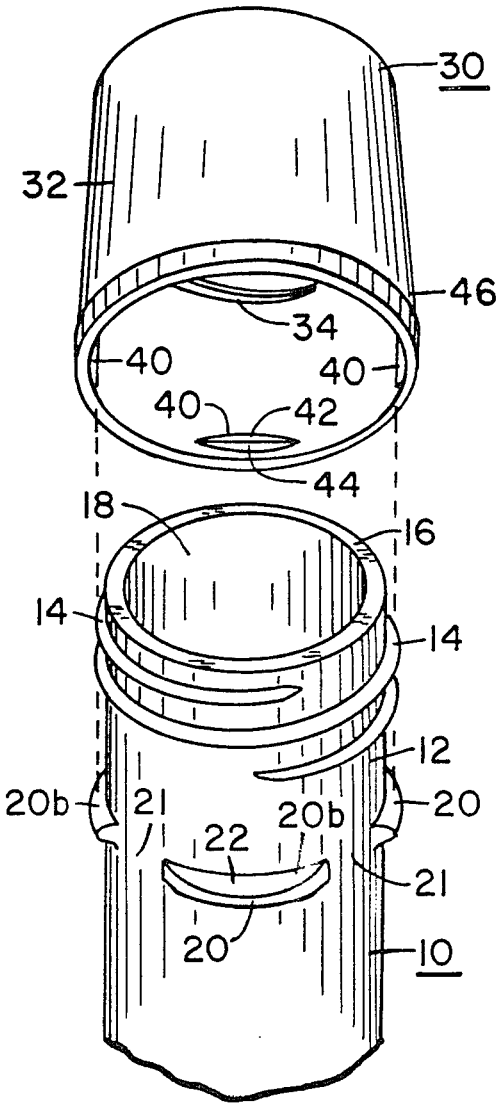
FIG. 4 is a further embodiment of a container and closure assembly of the present invention.

Referring now to FIG. 4, a further embodiment of the invention is disclosed which is similar to that shown in FIGS. 1–3, but with the exception that the outwardly-extending rim means 20 is in the form of a plurality of partial neck projections **20*b* which have gap portions 21 therebetween, and may be equally spaced around the neck 12 of the container 10 in a plane extending perpendicular to the axis of the cylindrical neck portion 12. Each of the partial neck projections 20*b* also has an outwardly-downwardly tapered surface 22 for engaging the taper surfaces 44 of the inwardly extending projections 40 of cap 30. The operation of the embodiment shown in FIG. 4 is similar to that shown in FIGS. 1–3, with the exception that after the inwardly extending projections 40 have engaged the tapered surfaces 22 of the partial neck projections 20*b* to position the closure 30 in a predetermined slightly open position on the container 10, and additional torque is applied to the closure, the gap portions 21 between the partial neck projections 20*b* permit the closure projections 40 to slide therethrough, rather than over the continuous rim 20*a* of the embodiment of FIGS. 1–3**, and permit the sealing surfaces of the closure to engage the sealing surfaces of the container for sealably closing the same. The same is true when unscrewing the cap from the closed position.

Although I have disclosed the now preferred embodiments of my invention, it will be apparent to those skilled in the art that various modifications and changes may be made thereto without departing from the spirit and scope of the invention as set forth in the following claims.

I claim:

1. An improved closure and container assembly for positively and stably positioning the closure in a predetermined semi-open positionment on the container and for providing a sealing engagement between the closure and the container which comprises:

a container having a substantially cylindrical neck portion terminating in an upper open mouth portion;

first thread means formed on said neck portion below said open mouth portion;

rim means formed on said neck portion below said thread means at a predetermined distance from said open mouth portion and lying within a plane extending perpendicular to the cylindrical axis of said neck portion;

said neck portion having sealing surface portions thereon;

a closure having a downwardly extending skirt portion;

second thread means formed on said skirt portion cooperably engageable with said first thread means formed on said neck portion of said container;

projection means projecting from said skirt portion and cooperably engageable with said rim means formed on said neck portion for creating a binding action therebetween as said second thread means engage said first thread means when said closure is screwed downwardly on said container and for positively and stably positioning said closure in a predetermined semi-open positionment on the container;

sealing surface portions on said closure cooperably engageable with the sealing surface portions on said neck portion for sealably closing said container when said closure is screwed downwardly on said neck portion beyond the binding action produced by said projection means and said rim means;

said projection means including a plurality of concentric arcuately extending spaced-apart projections formed on an inner surface of said skirt portion which lie within a plane perpendicular to the axis of said skirt portion;

and said arcuately extending projections having a tapered lower surface which engages a tapered upper surface of said rim means for creating a binding action therebetween and positioning said closure in a predetermined semi-open postionment on the container.

2. An improved closure and container assembly as defined in claim 1 wherein said rim means is in the form of a continuous rim extending about an exterior surface of said neck portion.

3. An improved closure and container assembly as defined in claim 2 wherein said continuous rim has a tapered operating surface lying within a cone which intersects and is concentric with the cylindrical axis of said neck portion.

4. An improved closure and container assembly as defined in claim 1 wherein each said projection means extends arcuately about, and projects radially inwardly from, an inner surface of said skirt portion adjacent a lower extent of said skirt portion.

5. An improved closure and container assembly as defined in claim 1 wherein said rim means formed on said neck portion is in the form of a plurality of circumferentially spaced-apart neck projections formed about an outer surface of said neck portion and lying within a plane extending perpendicular to the cylindrical axis of said neck portion, and gap portions formed between adjacent neck projections permitting said projection means on said skirt portion to pass therethrough when said closure is screwed downwardly on said neck portion beyond the binding action produced by said projection means and said neck projections.

6. A closure and container assembly for positioning said closure in a predetermined semi-open positionment on said container and for sealably closing said container which comprises:

a container having a substantially cylindrical neck portion;

said neck portion having an upper open mouth portion surrounded by a sealing edge;

thread means formed on an outer surface of said neck portion below said sealing edge;

outwardly-extending rim means formed on an outer surface of said neck portion below said thread means and extending arcuately about said cylindrical neck portion within a plane extending perpendicular to the cylindrical axis of said neck portion;

said rim means including first tapered surface means lying within a cone concentric with said cylindrical axis for creating a binding action with said closure and for stably and definitely positioning said closure in a predetermined semiopen positionment on said container;

a closure member having a downwardly extending substantially cylindrical skirt portion;

thread means formed on an inner surface of said skirt portion cooperably engageable with the thread means formed on the outer surface of said neck portion;

arcuately extending projection means formed about an inner surface of said skirt portion and projecting radially inwardly therefrom adjacent a lower extent of the skirt portion;

said arcuately extending projection means including second tapered surface means lying within a cone concentric with the axis of said cylindrical skirt portion engageable with said first tapered surface means of said rim means for producing a binding action therebetween and definitely positioning said closure in a predetermined semi-open positionment on said container;

and sealing means on said closure engageable with sealing surface portions on said neck portion for sealably closing said container when said closure is moved downwardly past said binding action to a sealed position thereon.

7. A closure and container assembly as defined in claim 6 wherein said rim means is in the form of a continuous rim extending about an outer surface of said neck portion, and said first tapered surface means forms an outwardly-downwardly tapered upper surface on said continuous rim.

8. A closure and container assembly as defined in claim 6 wherein said outwardly-extending rim means is in the form of a plurality of circumferentially spaced-apart neck projections formed about an outer surface of said neck portion with gap portions formed between adjacent neck projections for facilitating the passage therethrough of said arcuately extending projection means formed on said skirt portion when said closure is moved downwardly into a sealed position on said container.

9. A closure and container assembly as defined in claim 6 wherein said first tapered surface means and said second tapered surface means lie in cones concentric with the cylindrical axis of said neck portion so that such surfaces engage each other within the surface of a cone to produce a binding action therebetween as the closure member is threaded downwardly on the container to thus position the closure in a predetermined semi-open positionment thereon.

10. A container and closure assembly for positioning said closure on said container in a predetermined semi-open positionment while permitting the sealing of said container by said closure which comprises:

a container haivng a substantially cylindrical neck portion with thread means formed thereon;

at least one first upwardly-facing binding tapered surface portion means formed on said neck portion lying within the surface of a cone concentric with the axis of said cylindrical neck portion;

a closure member having a substantially cylindrical skirt portion provided with thread means cooperably engageable with the thread means on said neck portion for threadably engaging said closure on said container;

at least one second downward-facing binding tapered surface portion means formed on said skirt portion and lying within the surface of a cone concentric with the axis of said cylindrical skirt portion;

and said first and second tapered surface means engageable with each other within the surface of a cone concentric with the axis of said neck portion and skirt portion for providing a binding action therebetween and positively and definitely position the closure in a semi-open positionment on said container.

* * * * *